United States Patent [19]

Stein

[11] Patent Number: 4,918,848

[45] Date of Patent: Apr. 24, 1990

[54] DISPLAY STAND FOR USE WITH WATER HEATERS

[75] Inventor: Geoffery Stein, Solon, Ohio

[73] Assignee: Mor-Flo Industries, Inc., Cleveland, Ohio

[21] Appl. No.: 268,757

[22] Filed: Nov. 9, 1988

[51] Int. Cl.[5] ..... G09F 7/00

[52] U.S. Cl. ..... 40/584; 40/124.2; 40/600; 40/611

[58] Field of Search ..... 40/124.1, 152.1, 306, 40/307, 642, 611, 306, 658, 618, 299, 584, 124.2, 124, 617, 592, 591, 649, 325, 319, 600; 248/467, 489, 214; 211/50, 106, 86, 107; D20/42

[56] References Cited

U.S. PATENT DOCUMENTS

| | | | |
|---|---|---|---|
| D. 175,481 | 8/1955 | Slavsky | D20/42 |
| D. 260,782 | 9/1981 | DeMars | D20/42 |
| 1,089,569 | 3/1914 | MacKinnon | 211/106 |
| 1,396,027 | 11/1921 | Day | 40/124.1 |
| 1,603,954 | 10/1926 | Huston | 40/617 |
| 1,652,907 | 12/1927 | Nelson et al. | 40/307 |
| 2,122,910 | 7/1938 | Garfinkle | 40/152.1 |
| 3,216,135 | 11/1965 | Wright | 206/232 |
| 3,585,747 | 6/1971 | Erickson | 40/124.1 |

*Primary Examiner*—James R. Brittain
*Assistant Examiner*—J. Hakomaki
*Attorney, Agent, or Firm*—Body, Vickers & Daniels

[57] ABSTRACT

A display stand for water heaters presenting information in an orientation easily read by a prospective purchaser is disclosed. The display stand is comprised of three flat panels, a top panel engaging the top of a water heater, a presentation panel, presenting information at an orientation slightly inclined with vertical and a stand off panel at the bottom of the presentation panel holding the presentation panel at a specific angle with respect to vertical and slightly away from the body of the water heater.

7 Claims, 3 Drawing Sheets

DISPLAY STAND FOR USE WITH WATER HEATERS

FIELD OF THE INVENTION

The present invention pertains to the art of display stands and more particularly to a device for attachment to a water heater for the display of sales information.

BACKGROUND OF THE INVENTION

Water heaters are sold to professional plumbing contractors and also to home owners and the like who prefer to install water heaters on a do-it-yourself basis. These do-it-yourself consumers often purchase water heaters through large discount stores, national department stores, home centers, and building supply outlets. Water heaters are displayed at these establishments for selection by the potential purchaser. Often several water heaters from several different manufacturers will be displayed for comparison shopping by the purchaser. It is important that information on the water heaters being displayed be associated with the water heaters themselves in a prominent, readable manner. This has presented problems in the past.

Most water heaters are generally cylindrical in overall shape. Many residential type water heaters are from about 4 ½ to about 5 ½ feet tall. While water heaters are also made in different sizes, a major portion of water heaters sold to do-it-yourself installers are of the size described. This size presents problems in display. There is no convenient surface for affixing easily readable materials. The flat top of the water heater is too high. Information printed or taped to the top of the water heater cannot be seen by most individuals standing next to the water heater. A vertical stand on the top of the water heater is too high for convenient reading. Information taped to the side of the water heater is to low too be conveniently read when disposed vertically. However, as the best available surface is the side surface, one often sees information bearing papers taped to the side of the water heater. Potential purchasers must either stoop down to try to read the inconveniently placed paper or partially remove the paper from the water heater to lift it and read it. The paper may become disassociated from the water heater to which it pertains and confusion can result.

These and other problems are overcome by the present invention wherein a display stand adapted to hold sales information and be conveniently orientated on a water heater is provided.

SUMMARY OF THE INVENTION

In accordance with the present invention there is provided a water heater display stand comprised of a first generally flat panel adapted to display information, a second generally flat panel attached to the top of the first panel and forming an obtuse angle therewith and upon which are mounted attachment means adapted to engage the top of a water heater and a third generally flat panel attached to the bottom edge of the first panel forming an acute angle therewith and having a concave rear edge adapted to engage the cylindrical side wall of a water heater.

Further in accordance with the invention the angle formed by the second panel and the first panel is about between 90° and 105° and the angle formed between the third panel and the first panel is about between 65° and 85°.

More specifically in accordance with the invention, the angle formed between the second panel and the first panel is about 97° and the angle formed between the third panel and the first panel is about 74°.

Yet further in accordance with the invention the first panel of the display stand is provided with generally rectangular envelopes having transparent front surfaces and open edges for the receipt of paper or cardboard sheets upon which information on the water heaters is printed.

Still further in accordance with the invention two rectangular envelopes are provided with the top rectangular envelope having its open edge at the top and the lower rectangular envelope having its open edge at the side.

Yet further in accordance with the invention the attachment means on the second panel are magnets which will hold the panel firmly against the steel top of a water heater.

Yet further in accordance with the invention, the first panel, second panel and third panel are all part of a unitary plastic sheet.

The primary object of the present invention is to provide a water heater display stand which will display information at a height and angle convenient for inspection by prospective purchasers. Particularly, such display stand presents information at or near the top of the water heater inclined at an angle of from about 5° to about 20° with respect to vertical. Such an angle allows a prospective purchaser to read the information presented while standing in close proximity to the water heater without having to stoop or bend.

It is yet another object of the present invention to provide a display stand having pockets to allow the easy interchange of water heater information when the stand is moved from one type of water heater to another.

It is still a further object of the present invention to provide a display stand which is rigid, tough and inexpensive to manufacture.

It is still a further object of the present invention to provide a display stand which will present information at an easily readable orientation on any water heater of an approximately standard size.

It is still another object of the present invention to provide a water heater display stand which can be mounted on a water heater without marring the surface of the water heater or leaving adhesive behind when the display stand is removed.

It is still another object of the present invention to provide a display stand which conforms to the general configuration of a water heater so that it is stable when placed upon a water heater and will retain its position.

These and other objects and advantages of the invention will become apparent from the following description of a preferred embodiment thereof taken together with the accompanying drawings.

BRIEF DESCRIPTION OF THE DRAWINGS

The invention may take physical form in certain parts and arrangements of parts, a preferred embodiment of which is described in detail below and illustrated in the accompanying drawings form a part hereof and wherein.

THE DETAILED DESCRIPTION OF THE PREFERRED EMBODIMENT

Figure 1:
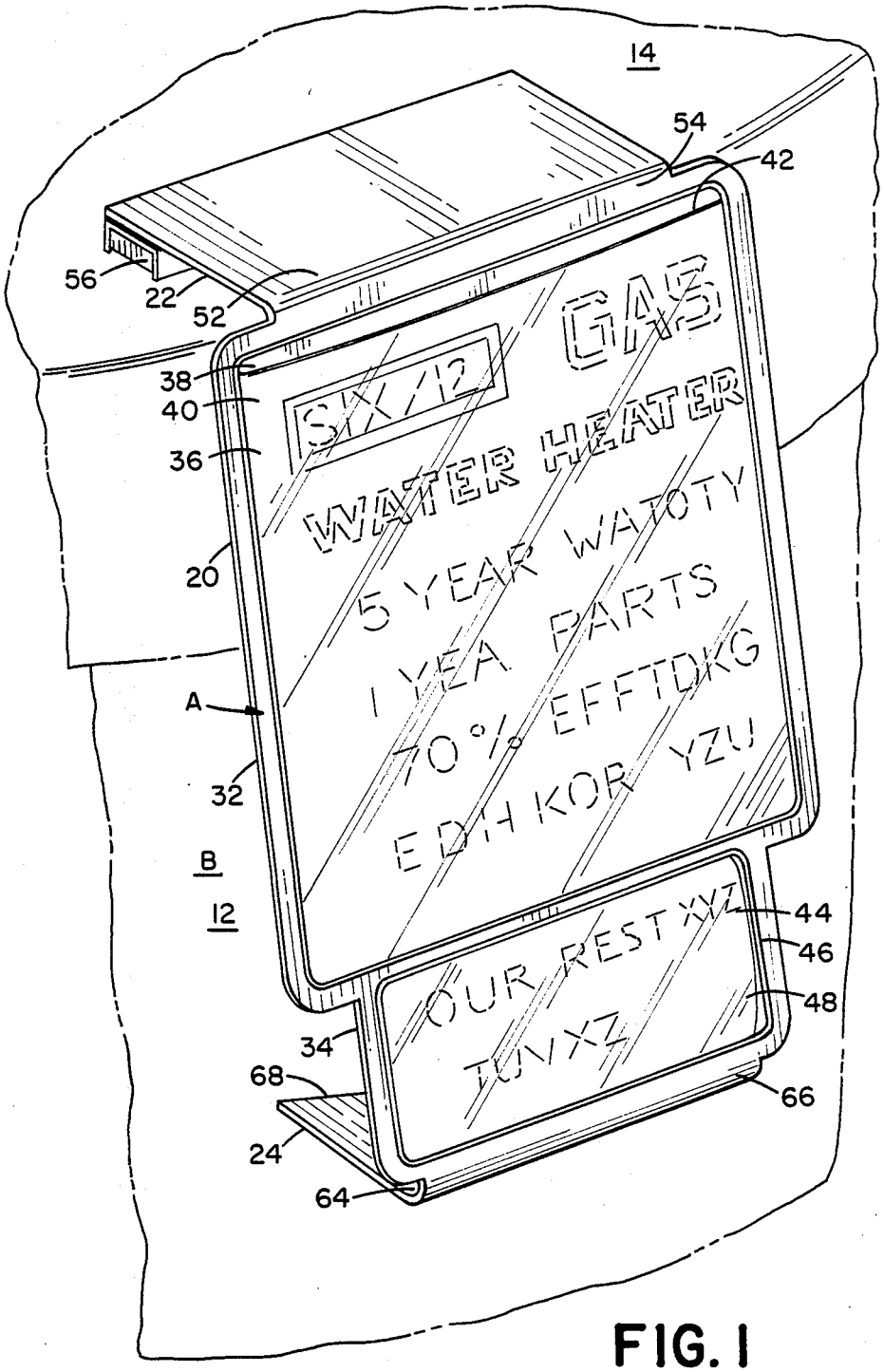
FIG. 1 is a perspective view of a water heater display stand illustrating the preferred embodiment of the present invention fixed to a water heater.
Figure 3:
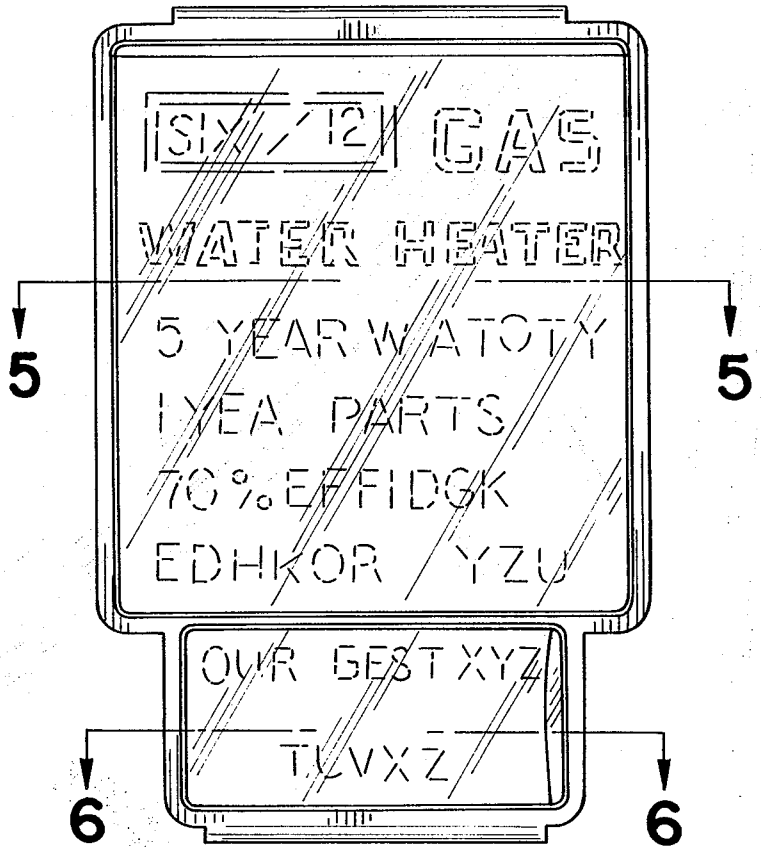
FIG. 3 a front elevation of the display stand of FIGS. 1 and 2 showing the water heater.

Referring now to the drawings wherein the showings are for the purpose of illustrating a preferred embodiment of the invention only and not for the purpose of limiting the same, FIG. 1 shows a water heater display stand A mounted on a water heater B. Conventional water heaters are generally cylindrical comprising an outer skin, usually of steel, having a continuous cylindrical side wall 12 and a circular top 14. The top 14 is conventionally steel. Both the side wall 12 and the top 14 are normally painted to protect these components and give the water heater a pleasing appearance.

Water heaters are available in numerous sizes. However, many residential water heaters are between 4 ½ and 5 ½ feet tall and between 18" and 30" in diameter.

The display stand A comprises a first generally flat panel 20, a second generally flat panel 22 and a third generally flat panel 24. The three panels are planar and formed from a single sheet of thick plastic material. The plastic material can be any suitable filled or unfilled resin compound having sufficient rigidity and toughness for generalized use.

The first flat panel 20 is comprised of an upper generally rectangular region 32 and a lower generally rectangular region 34. The upper generally rectangular region 32 is wider than the lower generally rectangular region 34. The four corners of the upper rectangular region 32 are rounded. A first plastic envelope 36 is adhesively bound to the first panel 20 in the upper rectangular region 32. The first plastic envelope 36 is conventional and comprises an inner plastic sheet 38 and an outer plastic sheet 40 joined together around three edges by heat welding or the like. At least the outer plastic sheet 40 is transparent. The top edge 42 of the outer plastic sheet 40 is not welded to the inner plastic sheet 38 providing an opening into the envelope 36. Paper or cardboard information containing sheets can be easily slid into and out of the envelope 36 through the opening at the top edge 42.

The lower generally rectangular region 34 has a second plastic envelope 44 adhesively fixed to it. Like the first plastic envelope 36, the second plastic envelope 44 has an inner plastic sheet 46 and an outer plastic sheet 48. The inner plastic sheet 46 and the outer plastic sheet 48 are welded together around their periphery except on one side where an opening is left for the insertion of sheets of information containing cardboard or paper.

Figure 2:
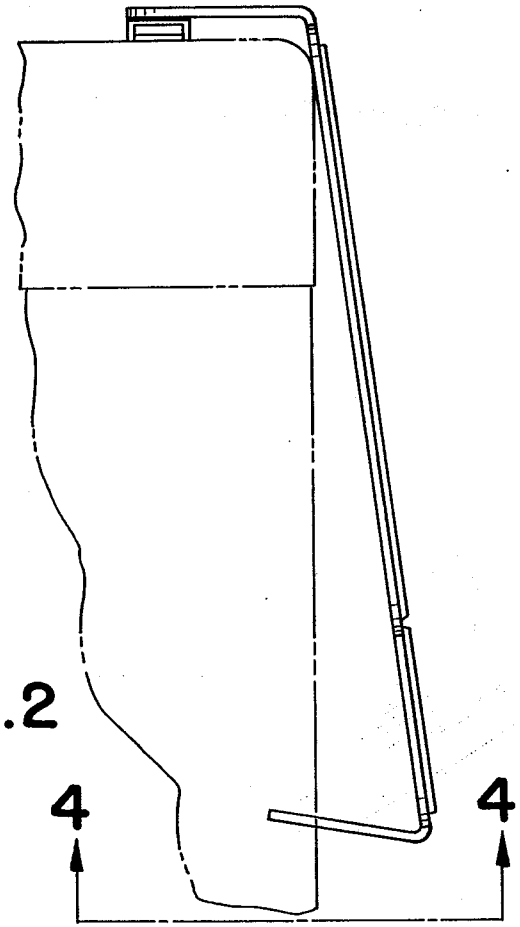
FIG. 2 is a side elevation of the display stand of FIG. 1.
Figure 4:
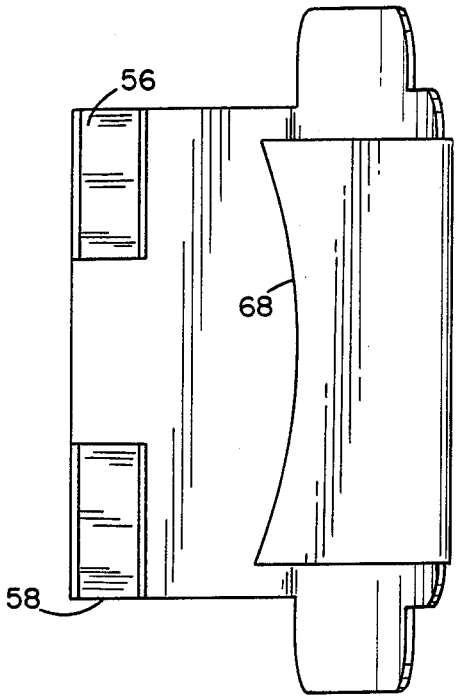
FIG. 4 a bottom view of the display stand in FIG. 3.
Figure 5:
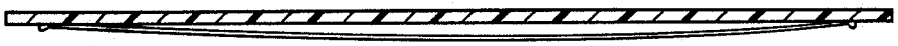
FIG. 5 sectional view taken along line 5—5 of FIG. 3.
Figure 6:
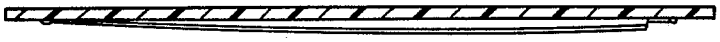
FIG. 6 is a sectional view taken along line 6—6 of FIG. 3.

The second generally flat panel 22 is rectangular in shape. Its outer edge 52 is integral with the upper edge 54 of the first flat panel 20. Two permanent magnets 56, 58 are adhesively bound to the underside of the second panel 22 near its inner edge 62. The magnets 56, 58 could be riveted or bolted to the flat panel 22 rather than glued. As can be best seen in FIG. 2, when viewed from the side, the second panel and first panel form an angle of about 97°.

The third generally flat panel 24 is located at the lower end of the first generally flat panel 20. The outer edge 64 of the third panel 24 is integral with the bottom edge 66 of the first panel 20. The third panel inner edge 68 is concave. It is adapted to generally follow the contour of the side wall 12 of a water heater. As can best be seen in FIG. 2, when viewed from the side, the third panel and first panel form an angle of about 74°.

The first panel 20, upon which information is displayed is about 14" tall. The second panel 22, upon which the magnets are disposed, is approximately three inches from front to back. The third panel 24, on the bottom of the first panel, is approximately three inches from front to back at its deepest point with about a half of inch of concavity such that the panel is about 2 ½ inches deep at its center and as shown lies entirely forwardly of the second panel 22. These depths, in relation with the angles formed between the first 20, second 22 and third 24 panels, provide for a convenient viewing angle for prospective purchasers on most water heaters. On water heaters which are somewhat taller than average, the top panel need not be pushed all the way back. The top of the first panel 20 will then stand away from the side wall 12 of the water heater B and the first panel will be orientated more vertically.

The angles between the first, second and third panels, 20, 22, 24 can be altered within reasonable ranges to accommodate slightly different viewing angles or different panel dimensions.

The display stand A is economically manufactured by die cutting or otherwise forming a rigid plastic sheet into the general shape of the three panels described. The die cut blank is then selectively heated along the upper edge 54 and bottom edge 66 of the first panel 20 and the second and third panels 22, 24 are bent along the heated lines to the desired angles. The magnets 56 and 58 are then adhesively mounted on the second panel 22 and the plastic envelopes 36, 44 are adhesively mounted on the first panel 20.

The plastic material for the display stand A is selected to be tough and rigid such that it will stand the abuse of normal use. A convenient easily used display stand presenting material in an attractive format at a level and orientation easily read by prospective purchasers is provided.

The invention has been described with reference to the preferred embodiment. It will be appreciated that modifications or alterations could be made without deviating from the present invention. For example, the angles between the first, second and third panels could easily be changed to achieve a slightly different angle or allow for different panel dimensions. These and other modifications and alterations will occur to others upon the reading and understanding of this specification. It is intended that all such modifications and alterations be included insofar as they come within the scope of the appended claims or the equivalents thereof.

Having thus described the invention, the following is claimed:

1. A display stand for use on water heaters comprising:

a single piece of rigid plastic sheet formed with a generally flat front first panel having a top edge, a bottom edge, a front surface adapted to display information, and a rear surface;

a generally flat imperforate top second panel immovably extending directly and rearwardly from said first panel and having a front edge rigidly fixed to said first panel top edge, a rear edge, a top surface, and a bottom surface with attachment means fixed thereon adapted to engage the top of a water heater, said second panel forming a fixed obtuse angle with the portion of said first panel extending therebelow; and a generally flat bottom third panel immovably extending directly and rearwardly from said first panel and having a front edge rigidly fixed to said first panel bottom edge and a rear edge, said third panel forming a fixed acute angle with the portion of said first panel extending thereabove; and said third panel rear edge being concave for engagement with the cylindrical side wall of the water heater to maintain the lower end of the display stand in lateral position thereon.

2. The display of claim 1 wherein said angle formed by said second panel and said first panel is about between 90 degrees and 105 degrees, and wherein said angle formed by said third panel and said first panel is about between 65 degrees and 85 degrees.

3. The display of claim 1 wherein said first panel front surface comprises a first generally rectangular region and a second generally rectangular region, and said display additionally comprise a first envelope fixed to said first rectangular region and having an open top edge and a transparent front wall; and, a second envelope fixed to said second rectangular region and having an open side edge and a transparent front wall.

4. The display stand of claim 1 wherein said first panel, said second panel and said third panel are portions of a unitary rigid plastic sheet.

5. The stand of claim 1 wherein said attachment means comprise magnets.

6. The display stand of claim 1, wherein the said third panel is of a length, at the center of its said concave rear edge, to support the display stand with its said first panel in a backwardly tilted position at an angle of from about 5° to about 20 ° to the vertical when the display stand is mounted on the water heater with the rear surface of its said first panel engaged at its top end with the top rim of the water heater.

7. The display stand of claim 1, wherein the said third panel is about 2 ½ inches in length at the center of its said concave rear edge, and the said center length of said third panel is offset entirely forwardly of said second panel.

* * * * *